US006848957B2

(12) United States Patent
Yashiro et al.

(10) Patent No.: US 6,848,957 B2
(45) Date of Patent: Feb. 1, 2005

(54) FITTING STRUCTURE FOR ELECTRICAL COMPONENT PART IN WATERCRAFT

(75) Inventors: Tomohiko Yashiro, Saitama (JP); Toru Hasegawa, Saitama (JP); Yusuke Funayose, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,065

(22) Filed: Oct. 29, 2002

(65) Prior Publication Data

US 2003/0134547 A1 Jul. 17, 2003

(30) Foreign Application Priority Data

Oct. 31, 2001 (JP) ..... 2001-334028

(51) Int. Cl.[7] ..... B63H 21/00
(52) U.S. Cl. ..... 440/88 D; 440/88 C
(58) Field of Search ..... 440/88 C, 88 D; 123/198 D

(56) References Cited

U.S. PATENT DOCUMENTS 5,078,627 A * 1/1992 Anderson ..... 440/1
5,694,895 A * 12/1997 Tsunoda et al. ..... 123/179.24
6,604,494 B2 * 8/2003 Skrzypchak et al. ..... 123/41.31

OTHER PUBLICATIONS

Patent Abstracts of Japan No. 07158547A; Jun. 20, 1995; Hiki Keiichi et al.; "Electic Apparatus Parts Installing Structure of Engine".

* cited by examiner

*Primary Examiner*—Ed Swinehart
(74) *Attorney, Agent, or Firm*—Birch, Stewart, Kolasch & Birch, LLP

(57) ABSTRACT

An electrical component part is fitted to an exterior wall surface of a cooling water passage in a water-cooled engine mounted on a watercraft within a containment structure. The water-cooled engine integrally includes a water tank which forms the cooling water passage and which includes an oil cooler in the inside thereof. The electrical component may be a rectifier connected to a generator and fitted to an outside wall surface of the water tank. A method of cooling the electrical component within the aforementioned containment structure prevents undesirable increases in the temperature of an electrical component part. The water tank may be formed integrally as a single body with an oil tank.

16 Claims, 17 Drawing Sheets

FITTING STRUCTURE FOR ELECTRICAL COMPONENT PART IN WATERCRAFT

CROSS-REFERENCES TO RELATED APPLICATIONS

This nonprovisional application claims priority under 35 U.S.C. §119(a) on Patent Application No. 2001-334028 filed in Japan on Oct. 31, 2001, the entirety of which is herein incorporated by reference.

BACKGROUND OF THE INVENTION

1. Field of the Invention

The present invention relates to a storage or fitting structure for electrical components, and more particularly to a storage or fitting structure for electrical components in a watercraft.

2. Description of the Background Art

As shown in FIGS. 17(*a*)–(*b*), a structure for storing or containing electrical component part(s) in a watercraft has been available in the background art, e.g., Japanese Patent Laid-open No. Hei 7-158547, the entirety of which is hereby incorporated by reference. FIG. 17(*a*) is a partial, sectional view showing a fitting structure for electrical component parts. FIG. 17(*b*) is a view taken along arrows b—b in FIG. 17(*a*). In FIGS. 17(*a*)–(*b*), an electrical equipment box 2 is disposed on the front side of a two-cycle, parallel three-cylinder engine 1. A rectifier 3, a CDI unit 4, etc. are contained in the inside of an electrical equipment box 2.

In the conventional fitting structure mentioned above, the electrical component parts such as the rectifier 3, the CDI unit 4, etc. are contained in the inside of the electrical equipment box 2. Accordingly, the temperature of the electrical component parts may easily be raised with this arrangement. In addition, since the rectifier 3 is connected to the generator that generates heat during power generation, the rectifier 3 may easily operate at a high operating temperature.

SUMMARY OF THE INVENTION

The present invention overcomes the shortcomings associated with the background art and achieves other advantages not realized by the background art.

An object of the present invention is to provide a fitting structure for electrical component parts in a watercraft that can solve the above-mentioned problems of the background art, including restraining undesirable increases in temperature of electrical component parts.

One or more of these and other objects are accomplished by a water-cooled engine mounted on a watercraft, comprising a water-cooled oil cooler having a cooling water passage, said cooling water passage having an exterior wall surface with a fitting portion, wherein said exterior wall surface encloses a cooling water containing portion of said water-cooled oil cooler; and a containment structure for an electrical component of the water-cooled engine having a plurality of interior wall surfaces, wherein said electrical component is housed within said containment structure and is secured to the fitting portion of the exterior wall surface of the cooling water passage and is surrounded by the interior wall surfaces of the containment structure.

One or more of these and other objects are further accomplished by a water-cooled engine for mounting on a watercraft, said engine comprising at least one electrical component for the water-cooled engine; a containment structure containing the at least one electrical component; and a cooling water passage for the engine, said cooling water passage having an exterior wall surface, wherein said cooling water passage supplies cooling water for at least one of an intercooler and a water-cooled oil cooler and the electrical component is secured to a fitting portion of the exterior wall surface and is surrounded by interior wall surfaces of said containment structure.

One or more of these and other objects are further accomplished by a method of cooling an electrical component for a water-cooled engine of a watercraft, the method comprising the steps of forming a containment structure on the above-described engine, securing at least one electrical component for the water-cooled engine to the exterior wall surface of the cooling water passage of the engine; and cooling the at least one electrical component with a supply of cooling water supplied directly from an exterior of the watercraft to the cooling water passage.

Since the electrical component parts are fitted to the outside wall surface of the cooling water passage in the water-cooled engine mounted on the watercraft, the electrical component part(s) are cooled by cooling water passing through the cooling water passage in the water-cooled engine through the outside wall surface. Therefore, the temperature of the electrical component part is prevented from undesirably increasing.

Particularly, where the electrical component part is a rectifier connected to a generator of the engine, the rectifier would easily acquire a higher temperature in the arrangements of the background art. However, the fitting structure of the present invention ensures that the rectifier can be favorably cooled. The fitting structure is particularly effective where the electrical component part is a component part that is likely to generate heat. In addition, since the engine generally has a large weight and is generally disposed at a central portion in the watercraft, even when the watercraft pitches or rolls heavily, or even capsizes, a small amount of water that may be present in the watercraft may be prevented from splashing onto the engine. Since the electrical components are connected to the engine, a waterproofing treatment for the electrical component parts can be simplified and easily obtained.

The water-cooled engine may integrally include a water tank which forms the cooling water passage and which includes an oil cooler in the inside thereof. The electrical component parts are fitted to an outside wall surface of the water tank. Therefore, the following beneficial effects may be obtained. Since a comparatively large quantity of cooling water passes through the water tank, including the oil cooler in the inside thereof, the electrical component part(s) is(are) cooled more favorably, and an undesirable increase(s) in temperature are prevented or eliminated. Water in the exterior of the watercraft is introduced directly into the cooling water passage in the water-cooled engine, so that cooling water at a comparatively low temperature is introduced into the cooling water passage, e.g., cooling water at a lower temperature as compared with cooling water introduced after already having cooled and absorbed another objects heat).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 9(*b*) is a front view of the tank main body;

FIG. 9(*c*) is a sectional view taken along line c—c in FIG. 9(*b*);

FIG. 9(*d*) is a sectional view taken along line d—d in FIG. 9(*a*);

FIG. 11(*b*) is a sectional view taken along line f—f of FIG. 9(*b*);

FIG. 12(*b*) is a sectional view taken along line b—b of FIG. 12(*a*);

FIG. 12(*c*) is a sectional view taken along line c—c of FIG. 12(*a*);

FIG. 12(*d*) is a sectional view taken along line d—d of FIG. 12(*a*);

FIG. 13(*b*) is a view taken along arrow b of FIG. 13(*a*);

FIG. 13(*c*) is a sectional view taken along line c—c of FIG. 13(*a*);

DETAILED DESCRIPTION OF THE PREFERRED EMBODIMENTS

Figure 1:
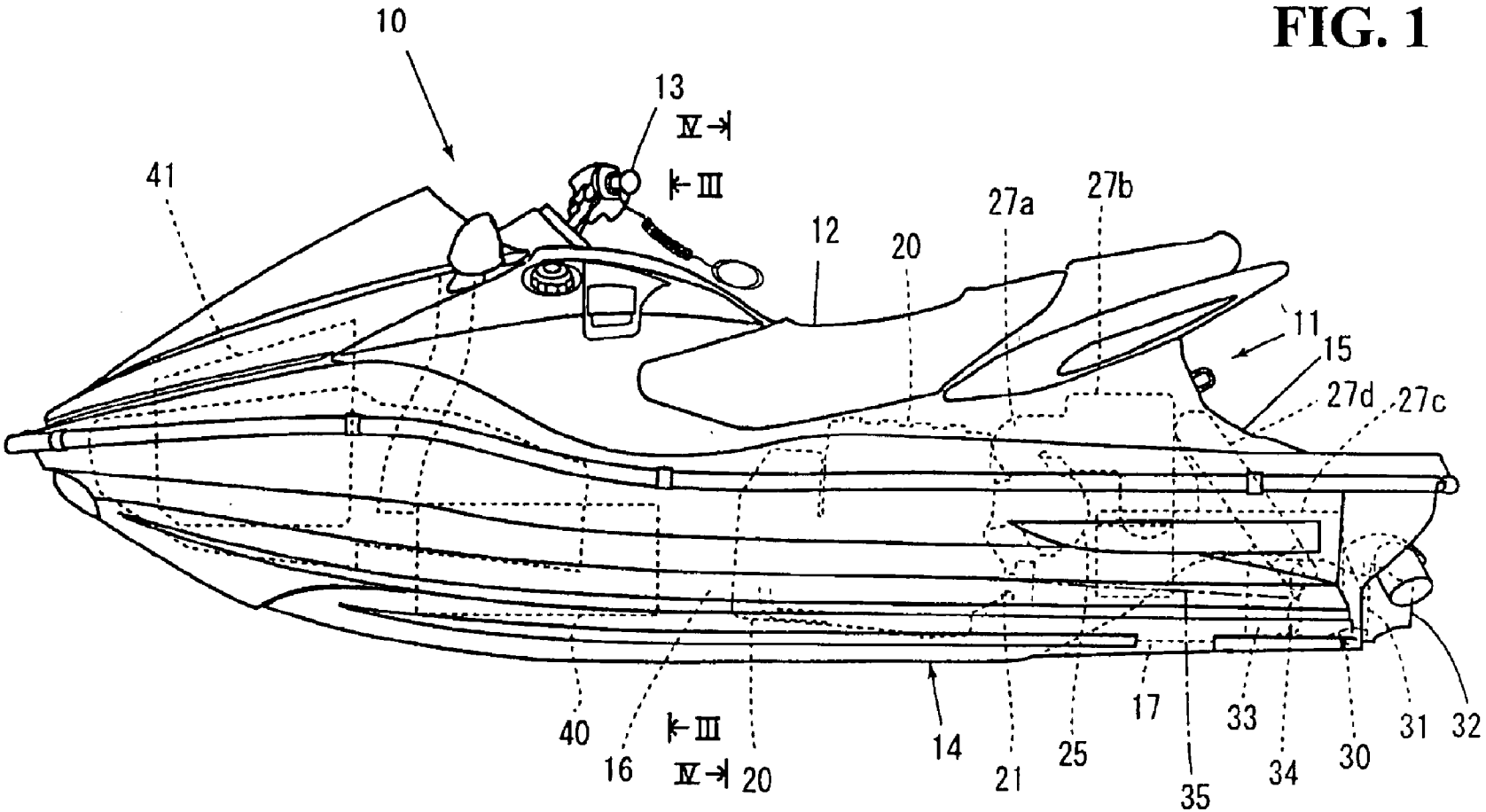
FIG. 1 is a side view of an exemplary personal watercraft having a containment structure for electrical component parts according to an embodiment of the present invention.
Figure 2:
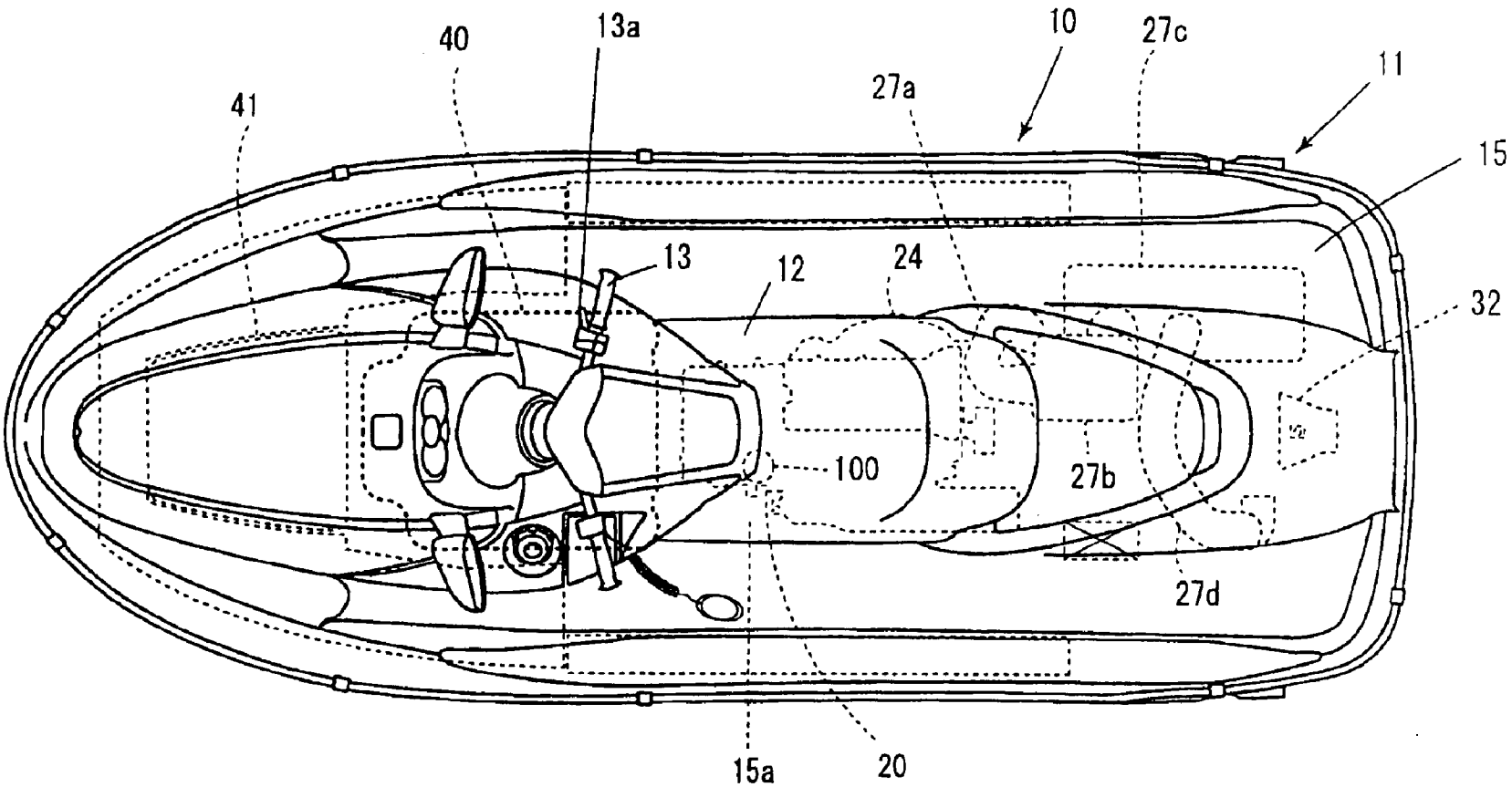
FIG. 2 is a plan view of the personal watercraft in FIG. 1.
Figure 3:
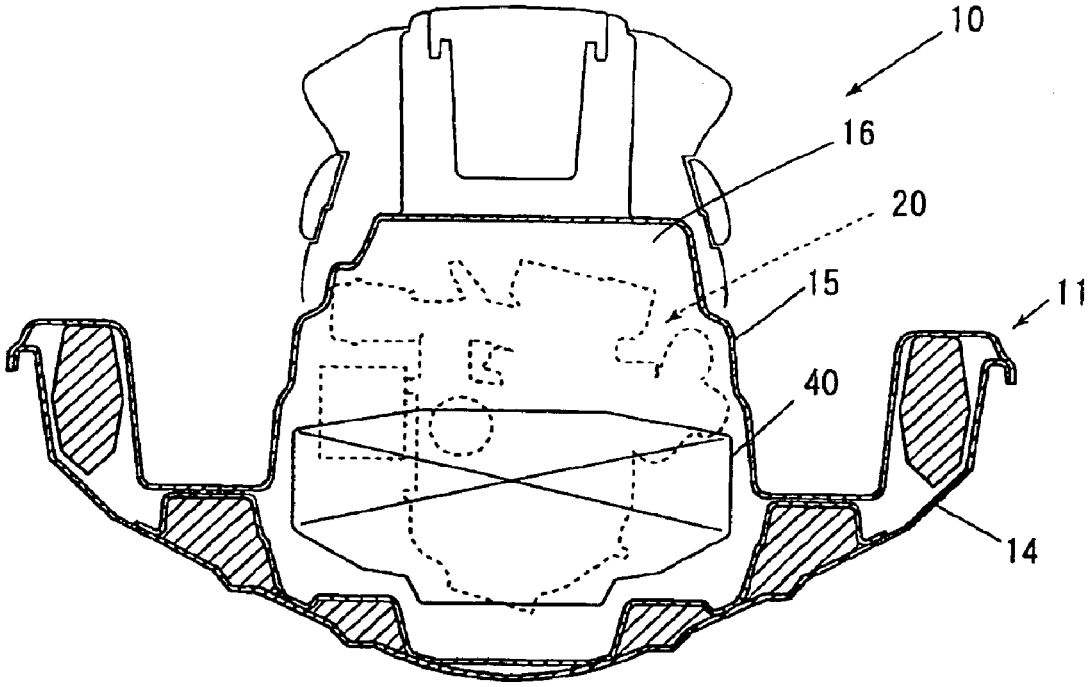
FIG. 3 is a partial, enlarged sectional view taken along line III—III of FIG. 1.
Figure 4:
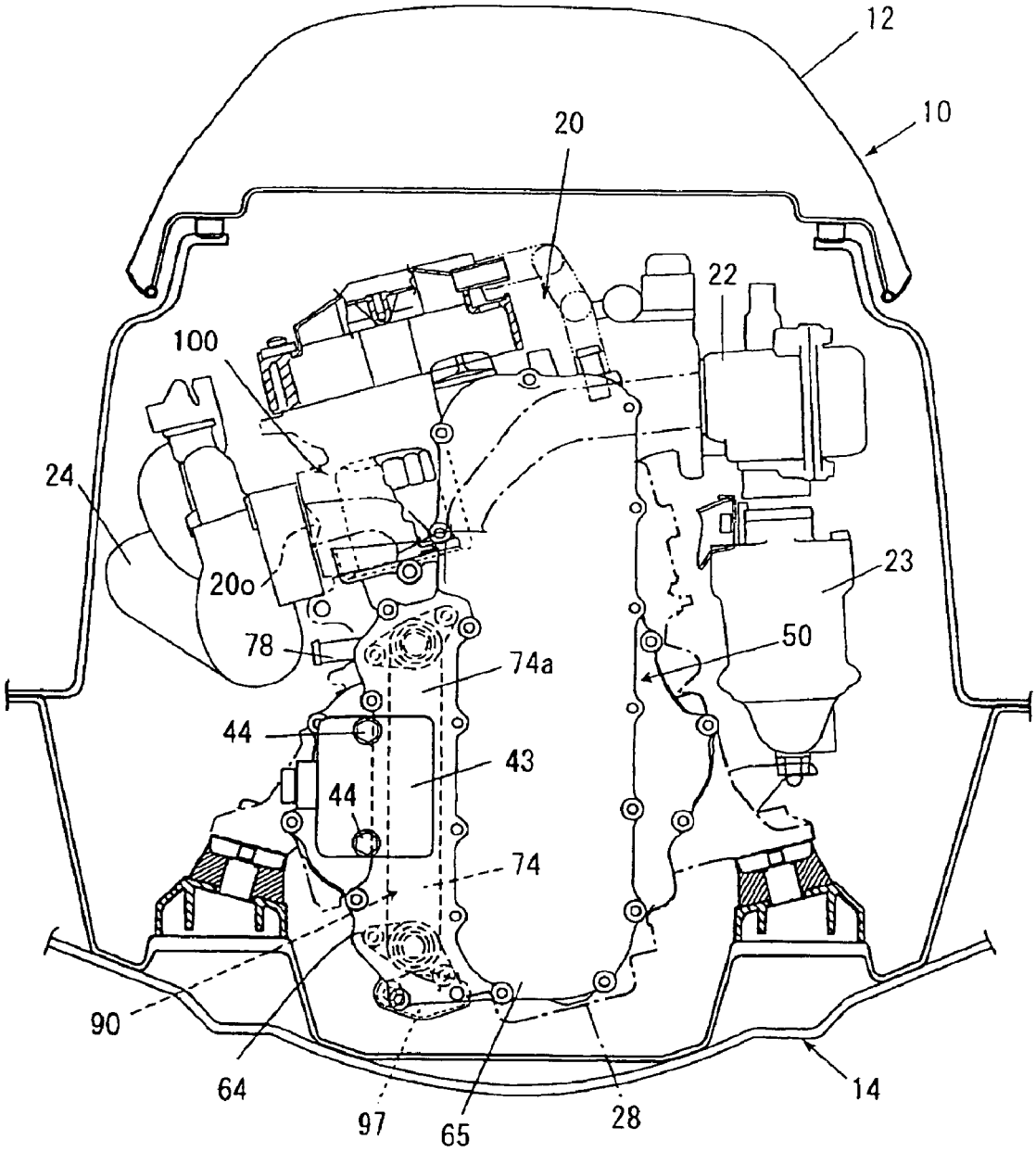
FIG. 4 is a partial, enlarged sectional view taken along line IV—IV of FIG. 1 and showing an engine.
Figure 5:
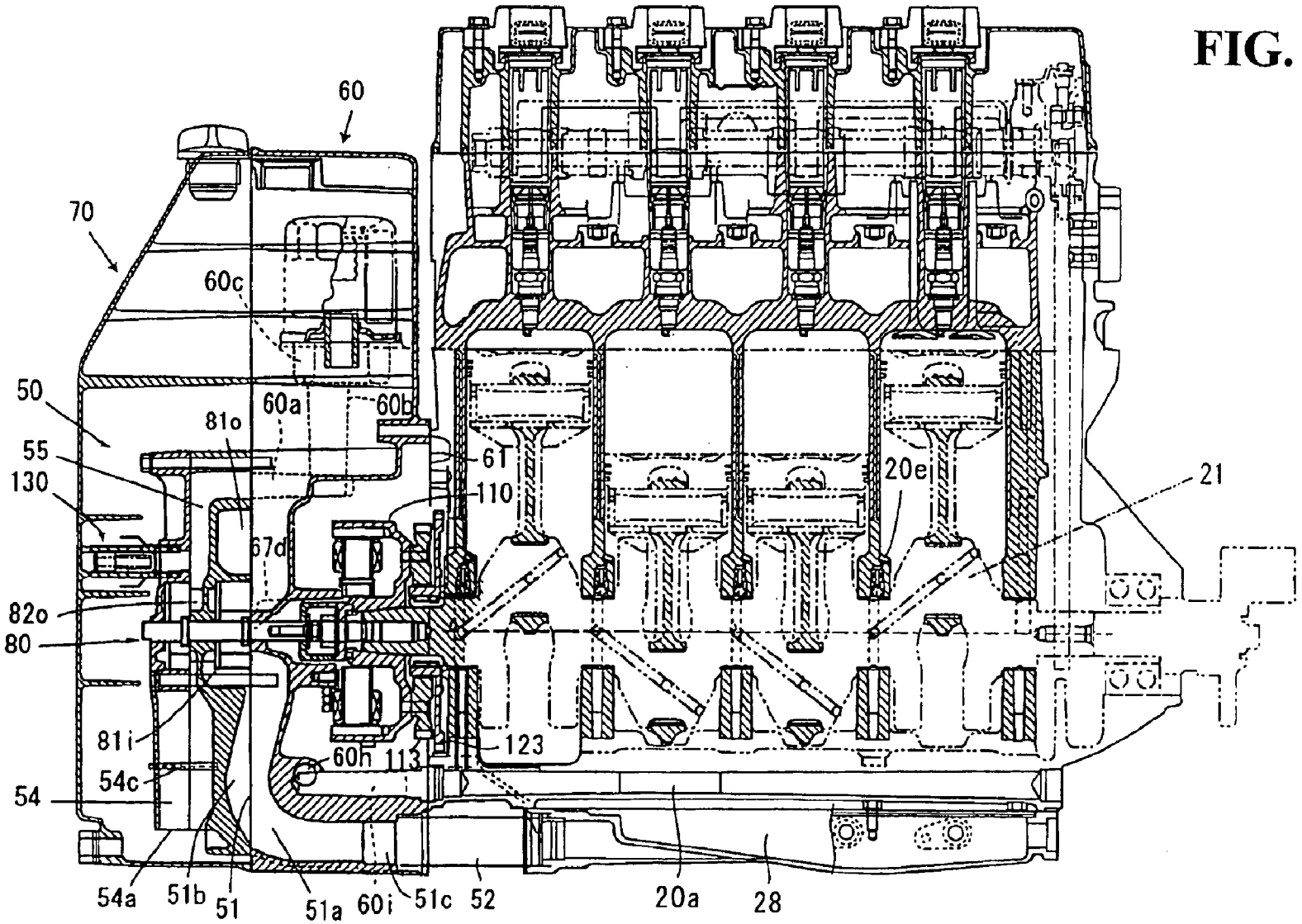
FIG. 5 is a right side view of the engine of FIG. 4.
Figure 6:
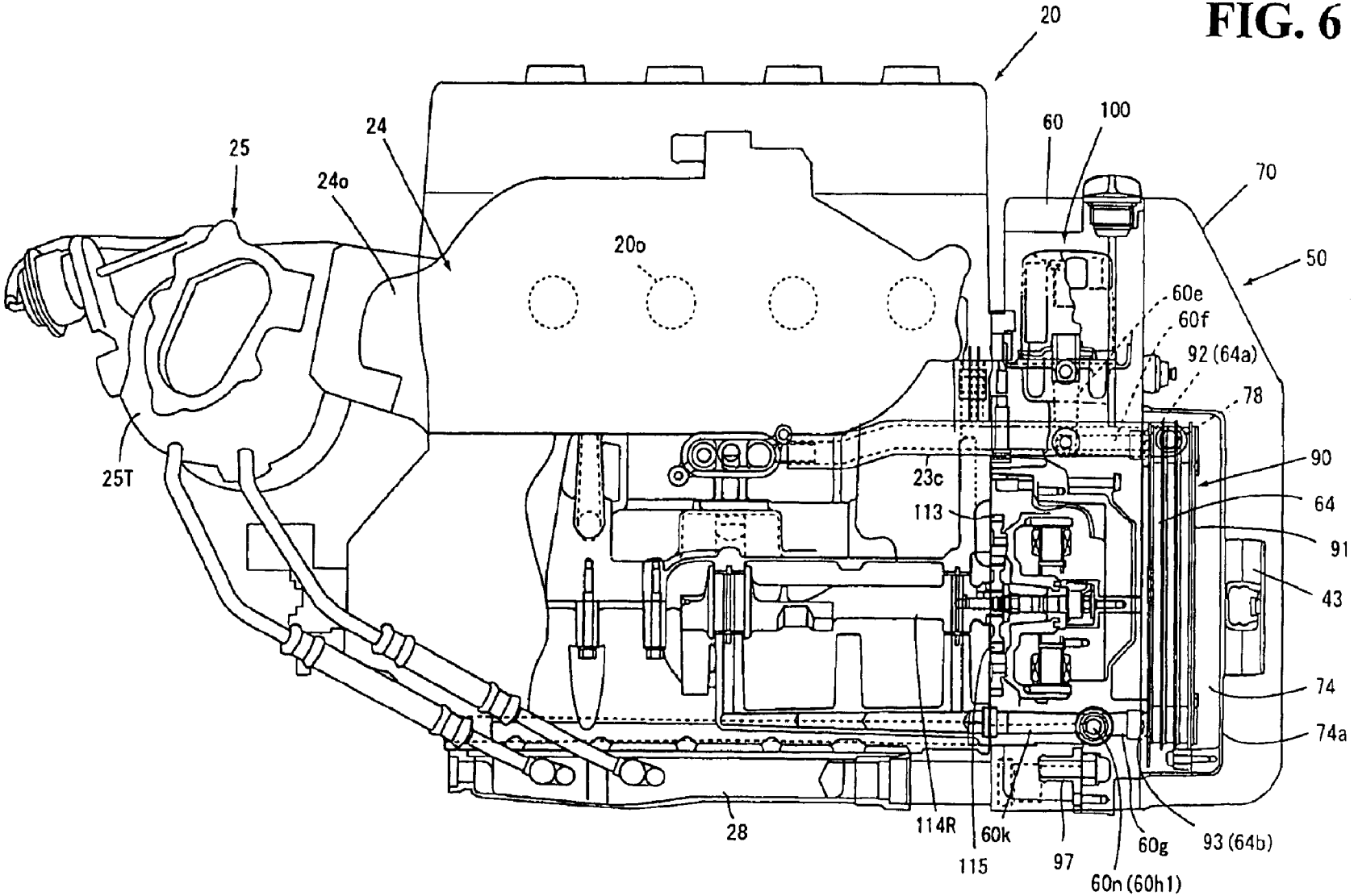
FIG. 6 is a left side view of the engine of FIG. 4.
Figure 7:
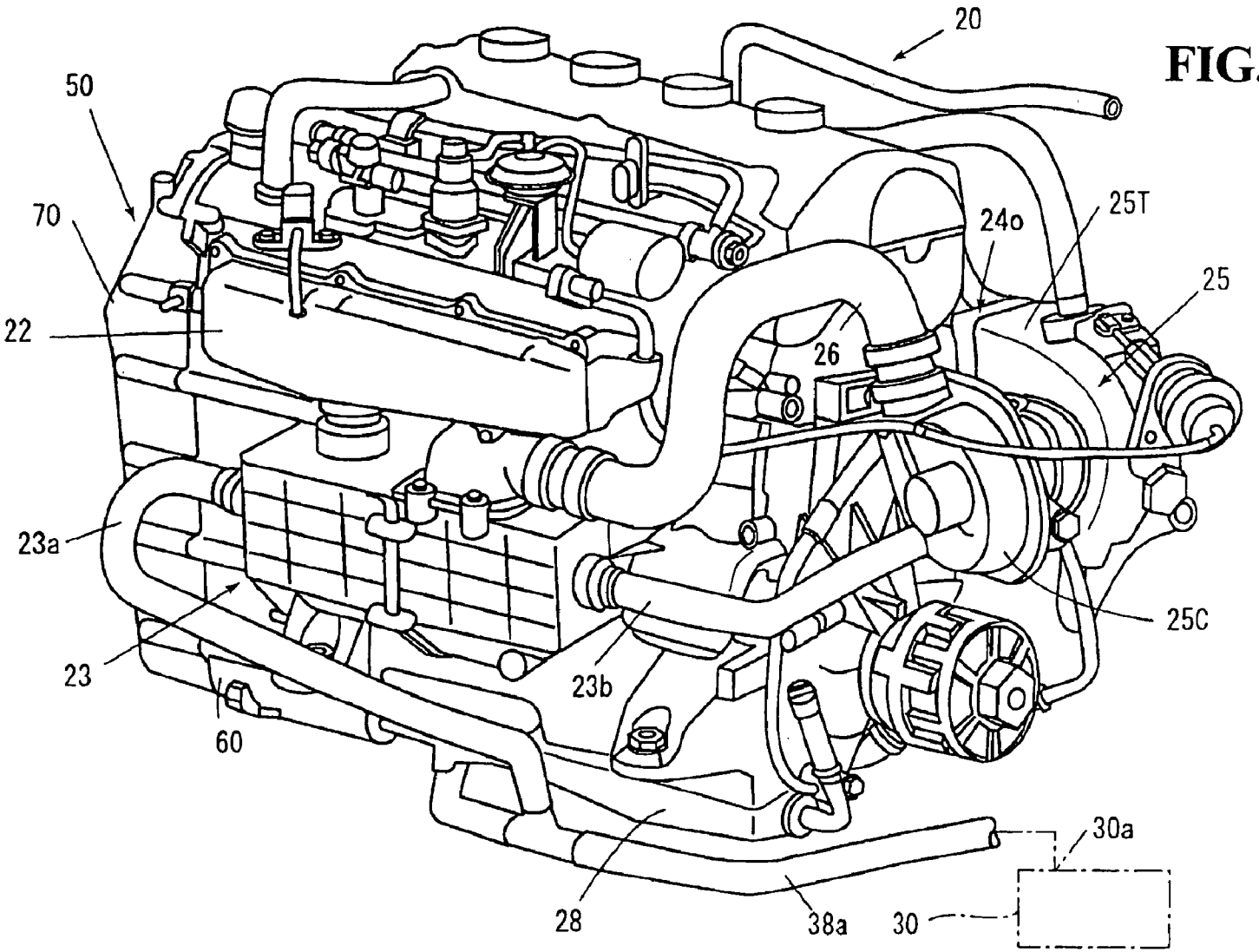
FIG. 7 is a perspective view of the engine according to an embodiment of the present invention.
Figure 8:
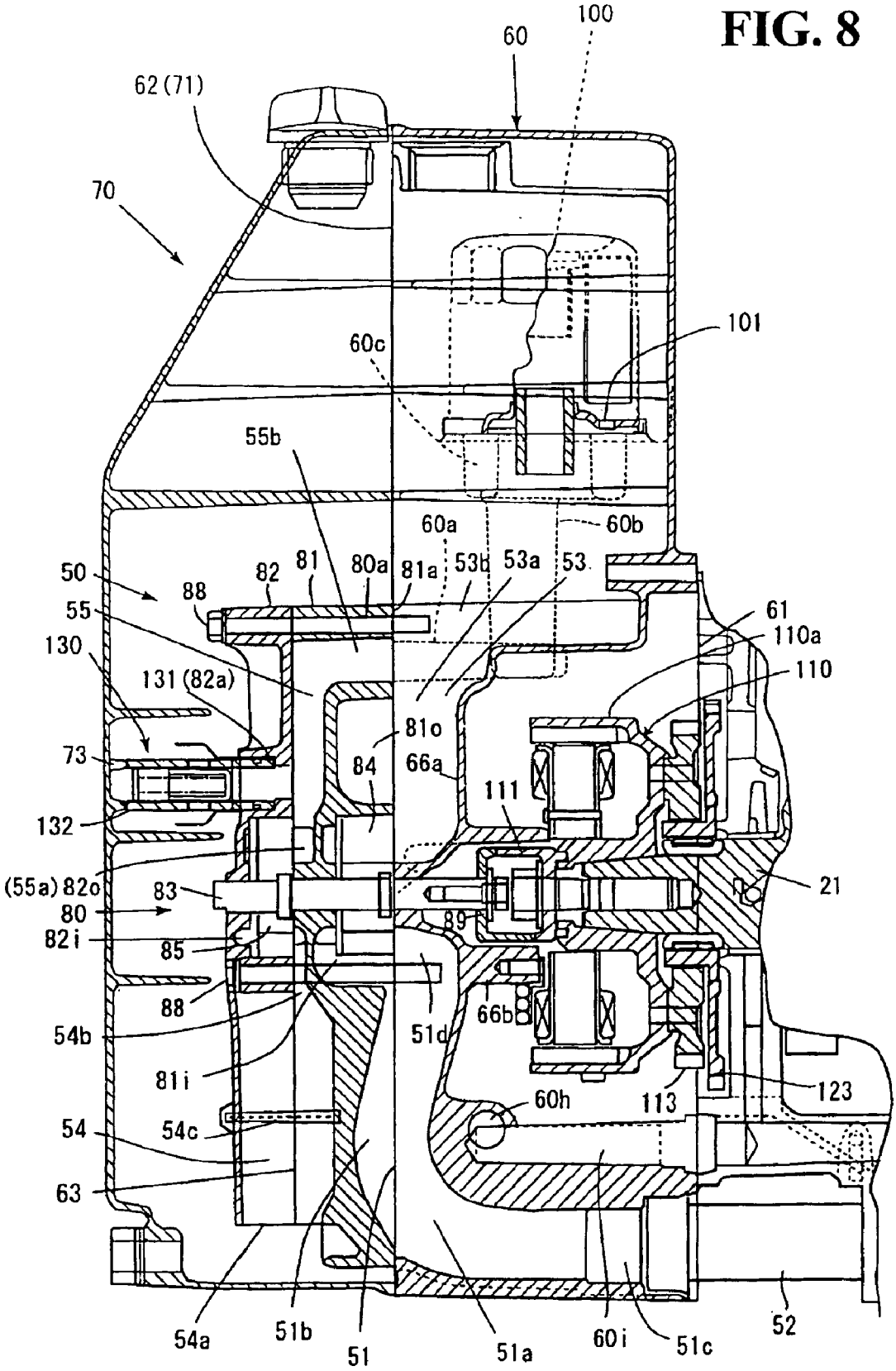
FIG. 8 is a partial, enlarged view of FIG. 5.
Figure 9A:
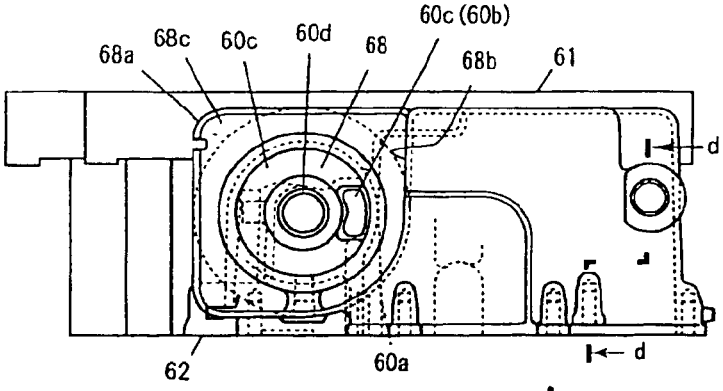
FIG. 9(*a*) is a plan view of a tank main body according to an embodiment of the present invention.
Figure 9D:
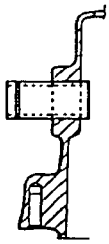
Figure 9B:
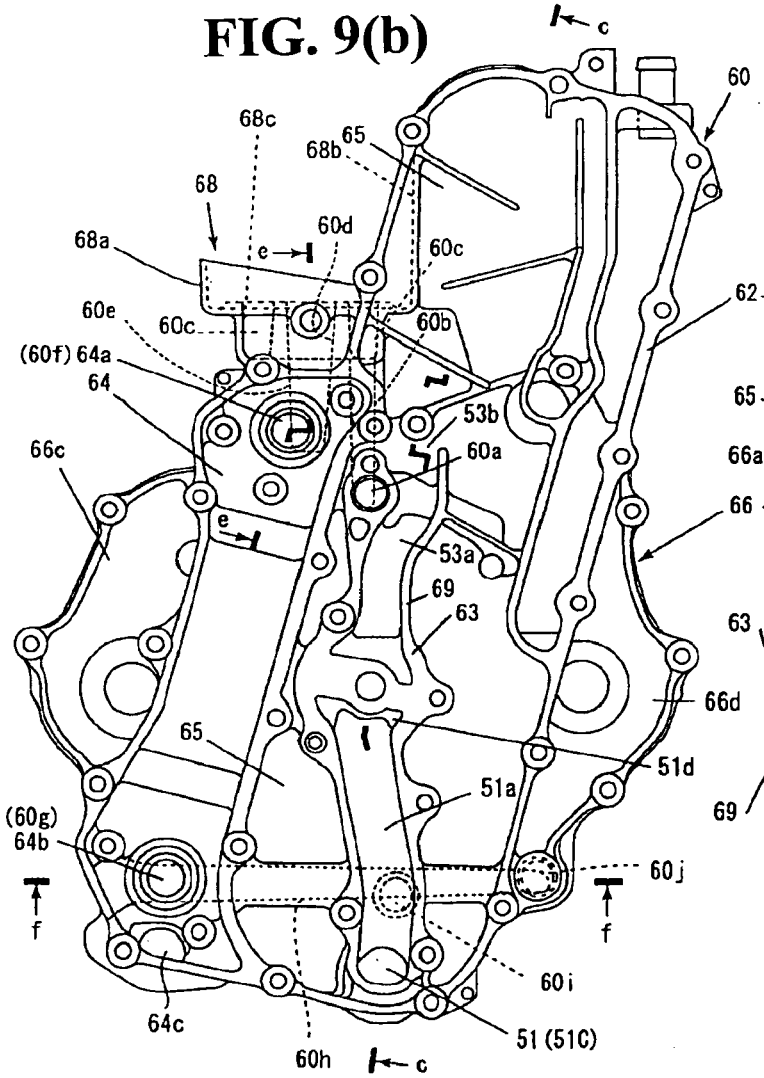
Figure 9C:
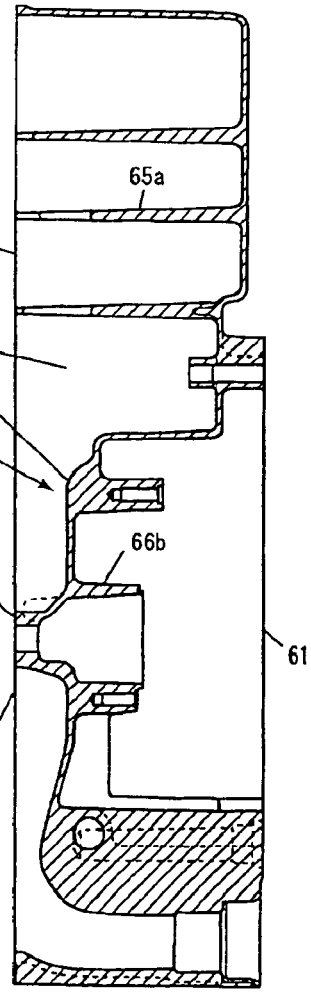
Figure 10:
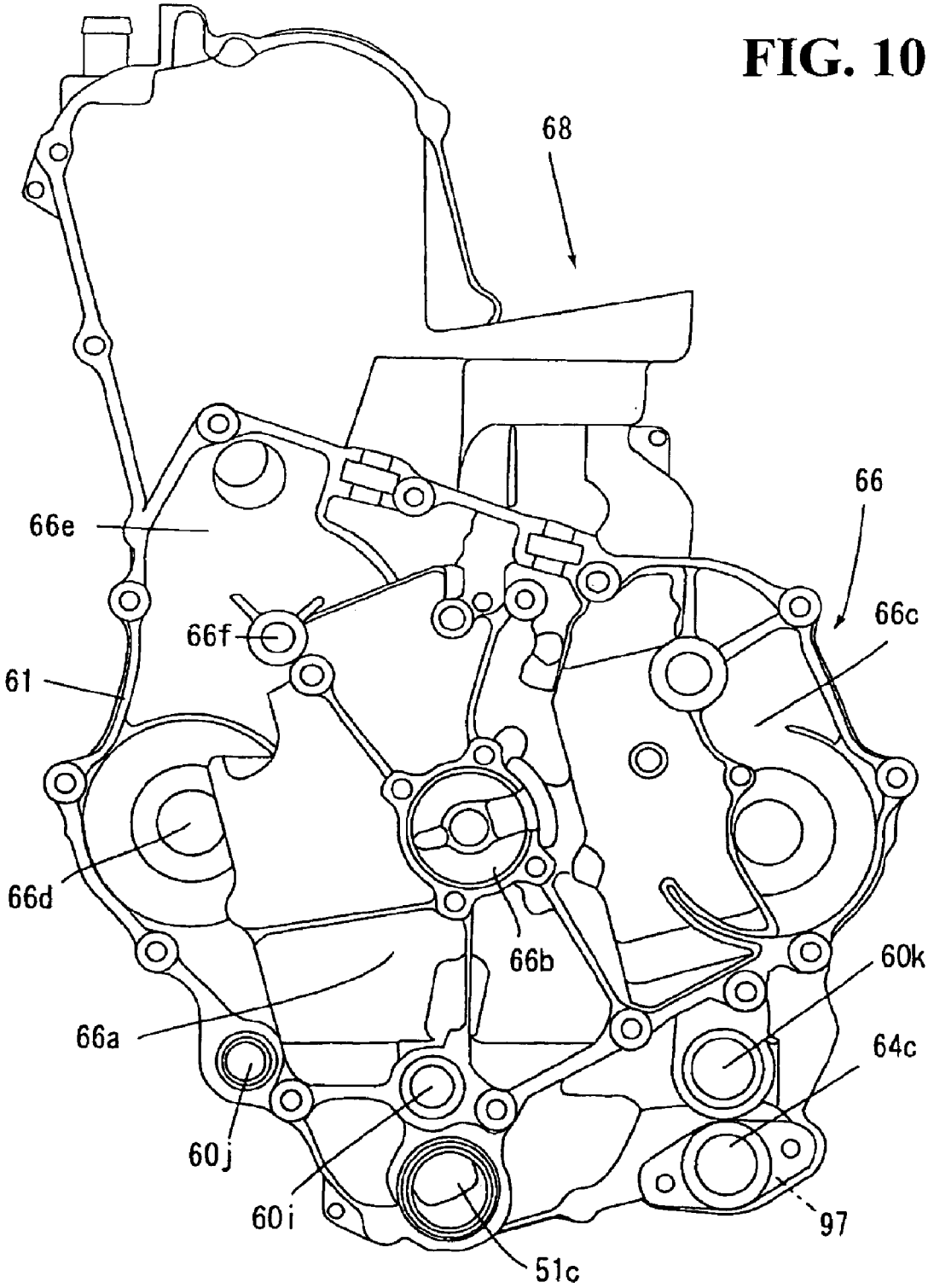
FIG. 10 is a rear elevational view of the tank main body.

The present invention will hereinafter be described with reference to the accompanying drawings. FIG. 1 is a side view of an exemplary personal watercraft having a containment structure for electrical component parts according to an embodiment of the present invention. FIG. 2 is a plan view of the personal watercraft in FIG. 1. FIG. 3 is a partial, enlarged sectional view taken along line III—III of FIG. 1. FIG. 4 is a partial, enlarged sectional view taken along line IV—IV of FIG. 1 and showing an engine. FIG. 5 is a right side view of the engine of FIG. 4. FIG. 6 is a left side view of the engine of FIG. 4. FIG. 7 is a perspective view of the engine according to an embodiment of the present invention. FIG. 8 is a partial, enlarged view of FIG. 5. FIG. 9(*a*) is a plan view of a tank main body according to an embodiment of the present invention. FIG. 9(*b*) is a front view of the tank main body. FIG. 9(*c*) is a sectional view taken along line c—c in FIG. 9(*b*). FIG. 9(*d*) is a sectional view taken along line d—d in FIG. 9(*a*). FIG. 10 is a rear elevational view of the tank main body.

Figure 11A:
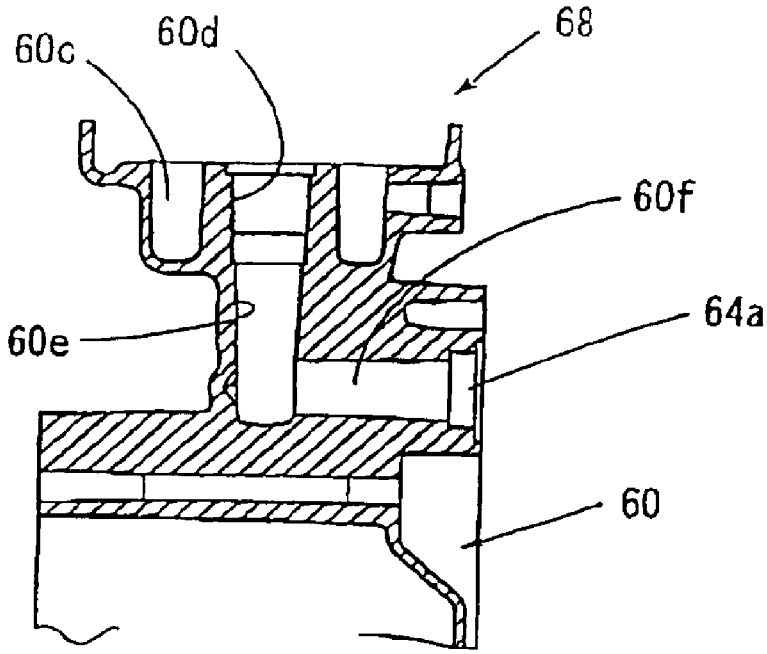
FIG. 11(*a*) is a sectional view taken along line e—e of FIG. 8(*b*)
Figure 11B:
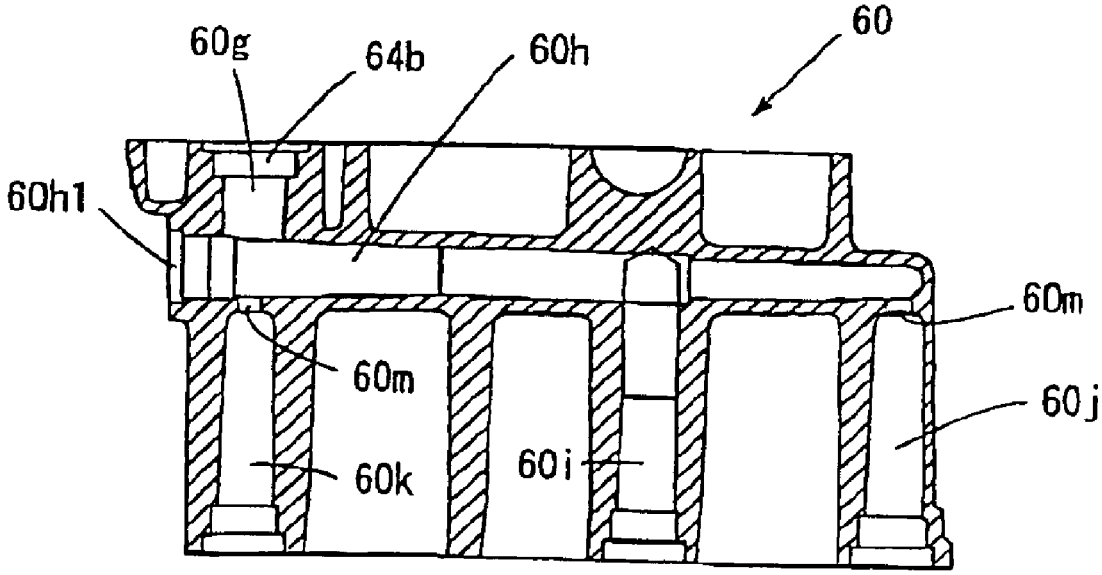
Figure 12B:
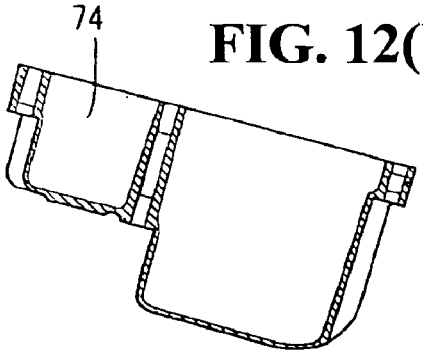
FIG. 12(*a*) is a front view of a cover.
Figure 12D:
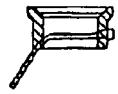
Figure 12A:
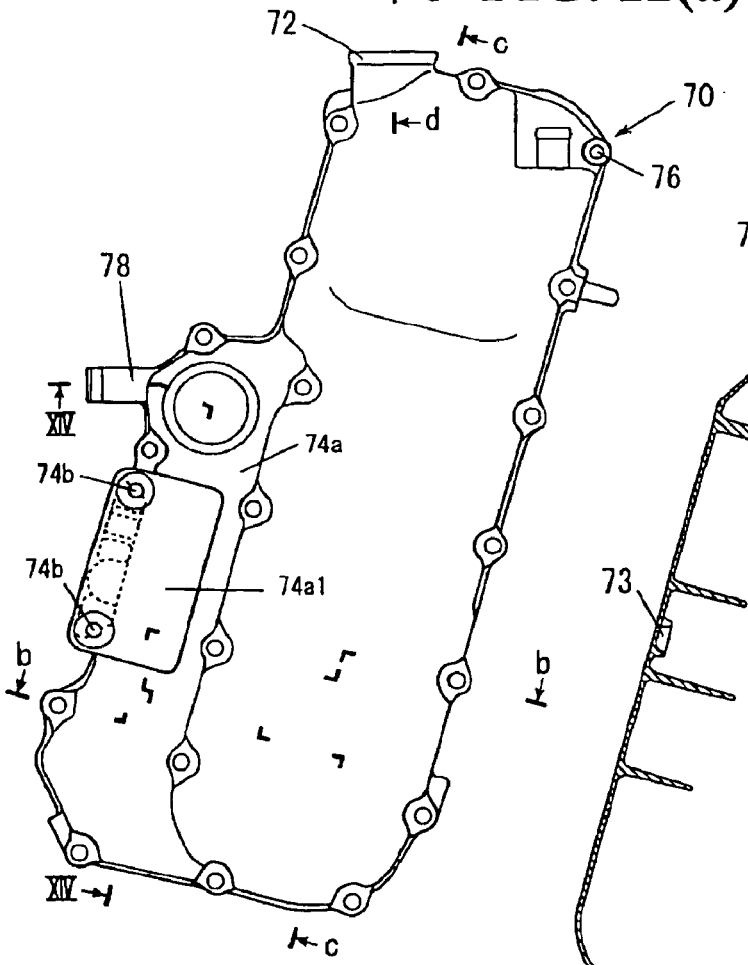
Figure 12C:
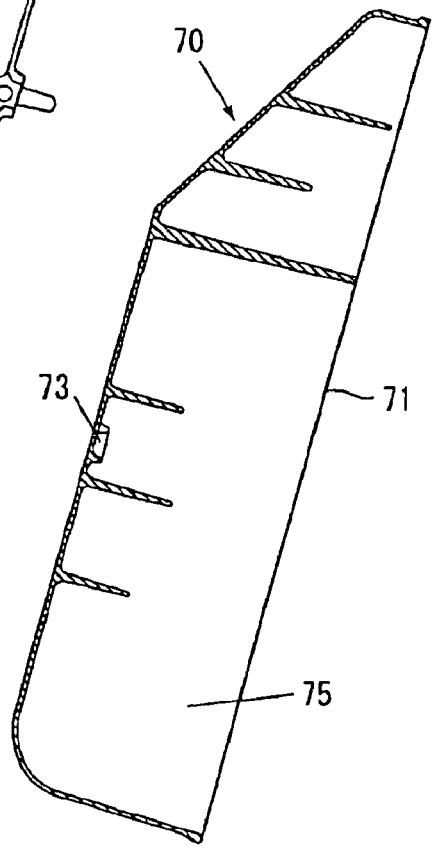
Figure 13B:
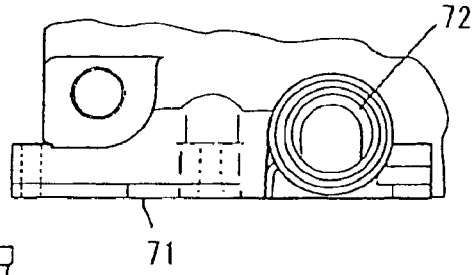
FIG. 13(*a*) is a rear elevational view of the cover.
Figure 13A:
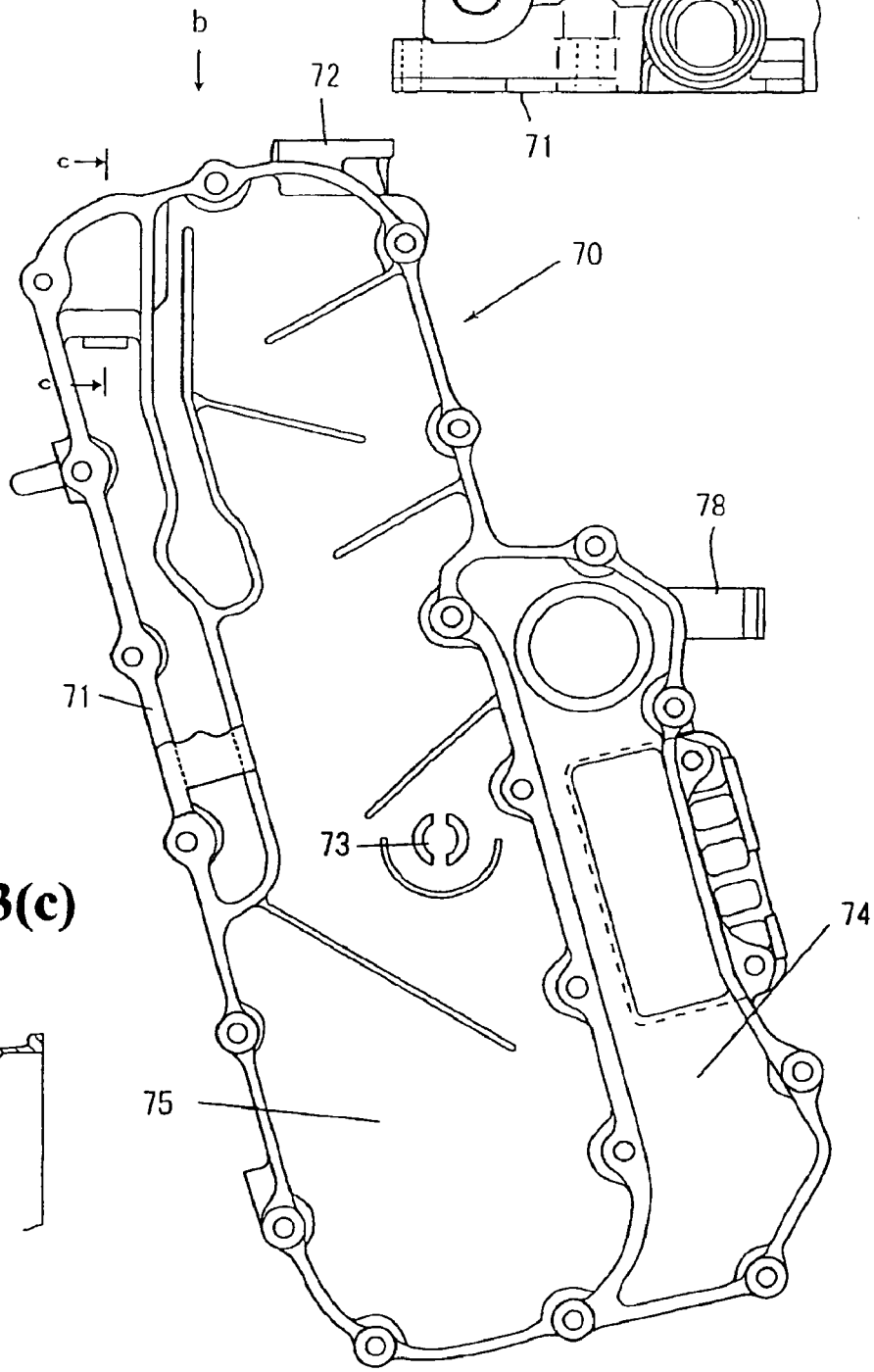
Figure 13C:
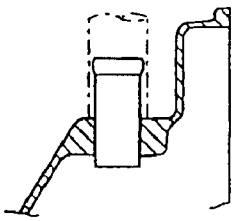
Figure 14:
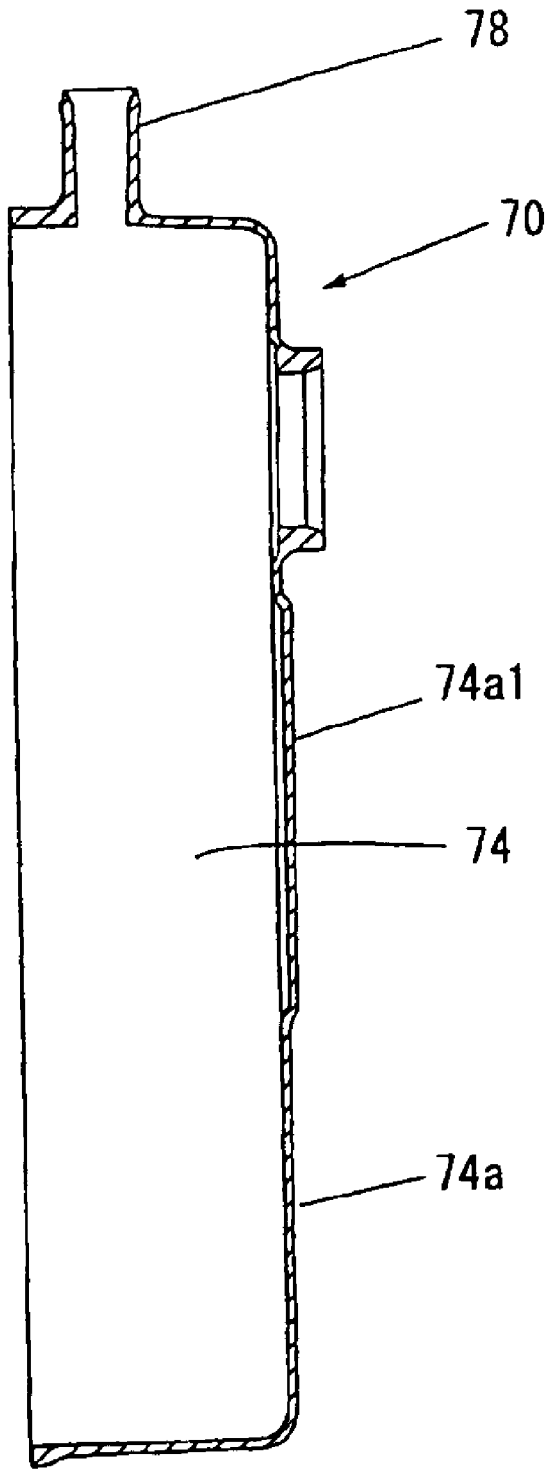
FIG. 14 is a sectional view taken along XIV—XIV of FIG. 12(*a*)
Figure 15:
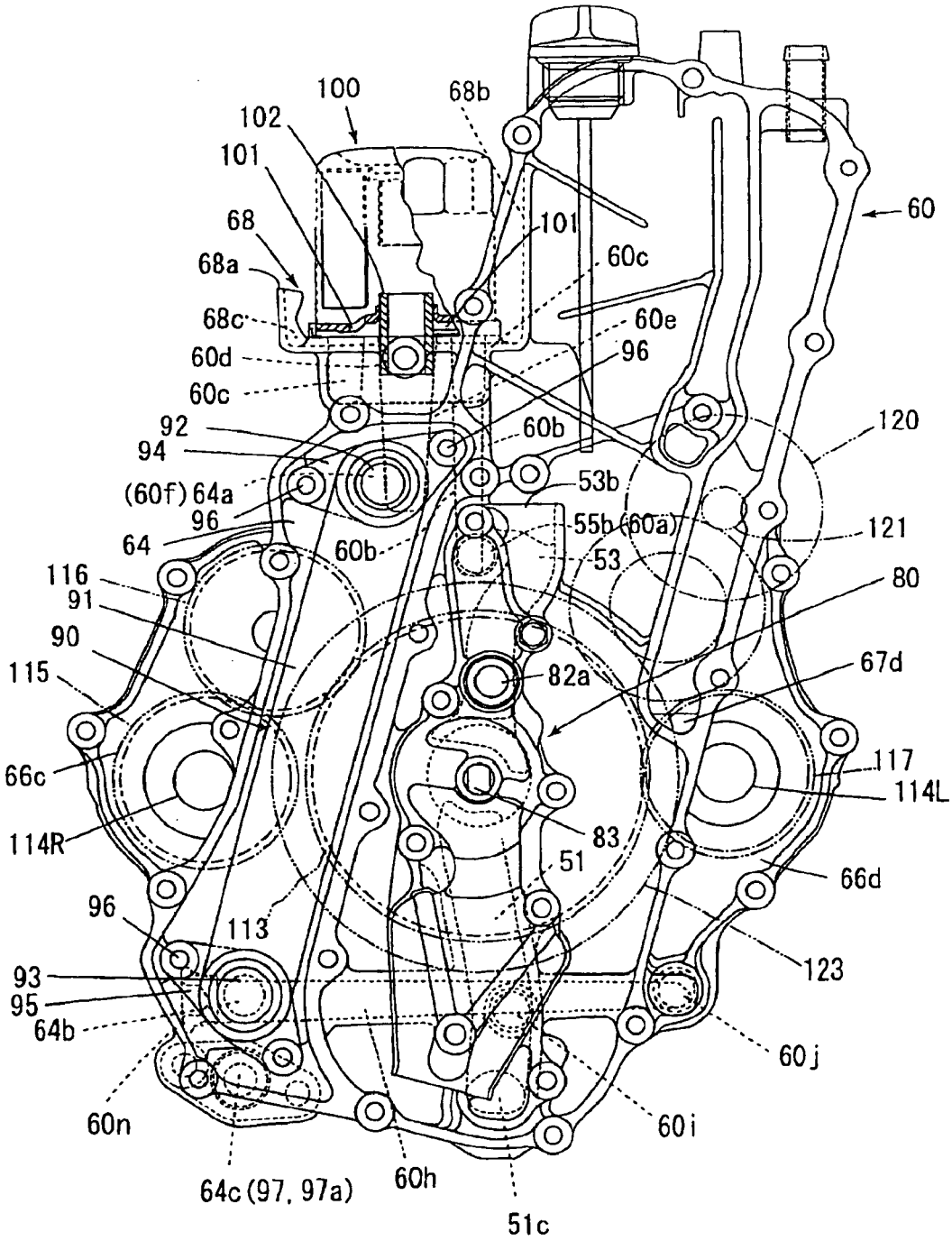
FIG. 15 is a partially enlarged view showing the condition where the cover in FIG. 4 is removed.
Figure 16:
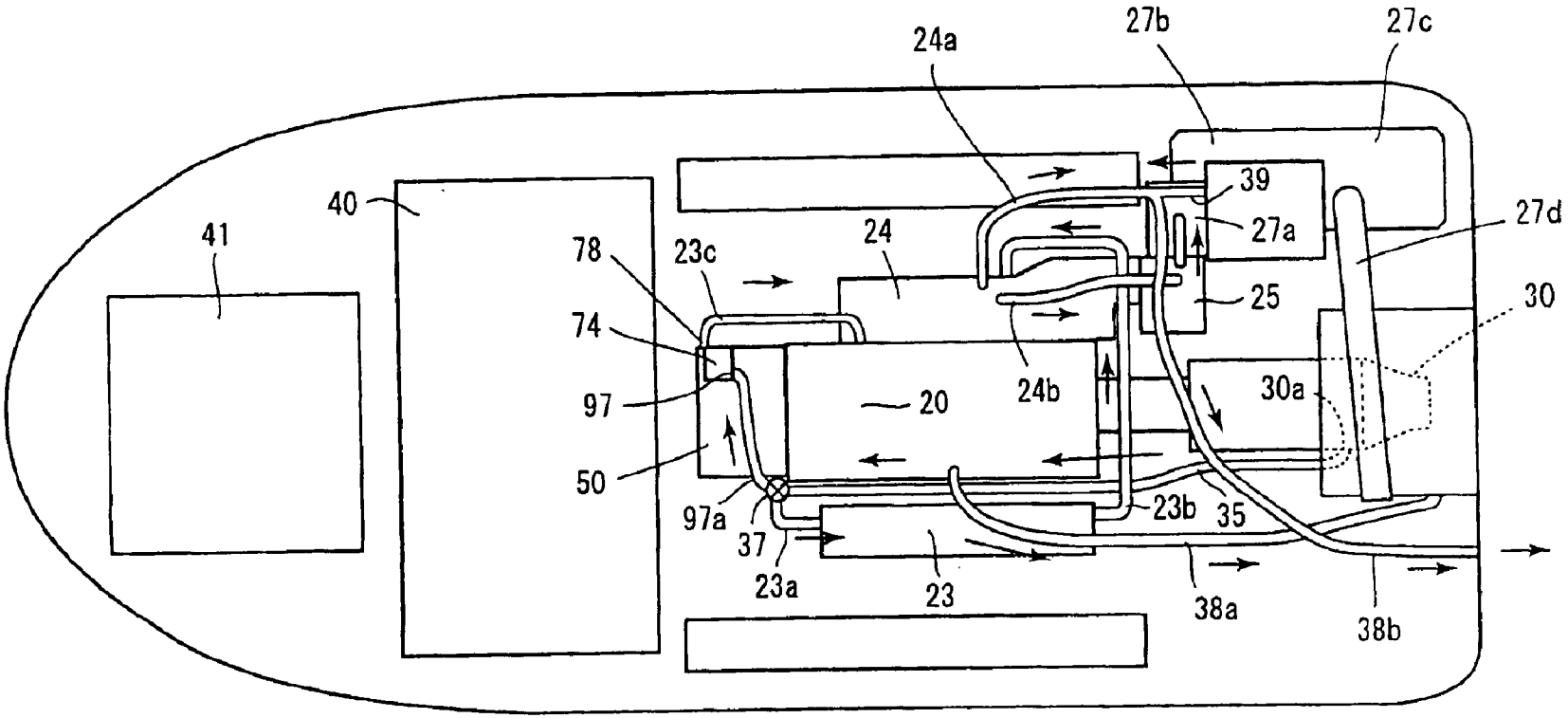
FIG. 16 is a schematic of cooling water system.
Figure 17A:
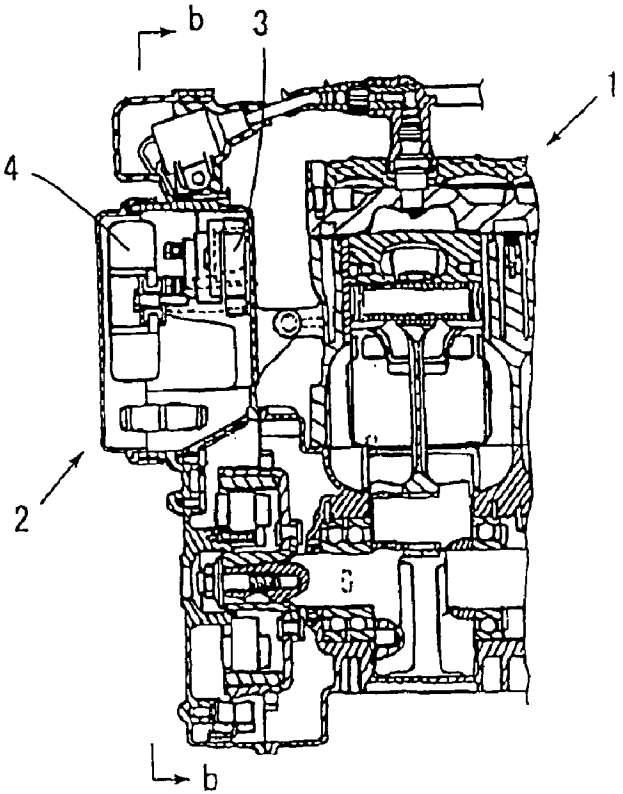
FIG. 17(a) BACKGROUND ART
FIGS. 17(*a*)–(*b*) are exemplary views of the background art.
Figure 17B:
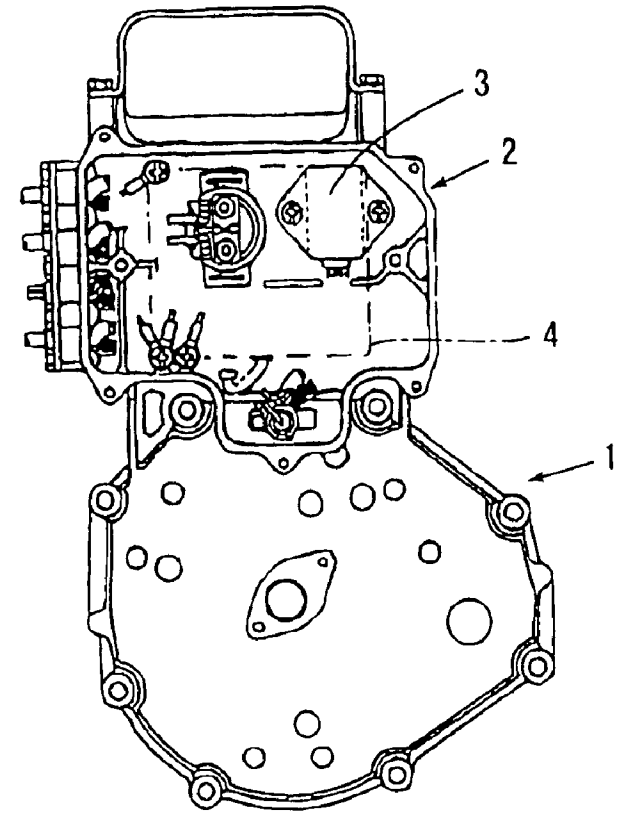
FIG. 17(b) BACKGROUND ART

FIG. 11(*a*) is a sectional view taken along line e—e of FIG. 8(*b*). FIG. 11(*b*) is a sectional view taken along line f—f of FIG. 9(*b*). FIG. 12(*a*) is a front view of a cover. FIG. 12(*b*) is a sectional view taken along line b—b of FIG. 12(*a*). FIG. 12(*c*) is a sectional view taken along line c—c of FIG. 12(*a*). FIG. 12(*d*) is a sectional view taken along line d—d of FIG. 12(*a*). FIG. 13(*a*) is a rear elevational view of the cover. FIG. 13(*b*) is a view taken along arrow b of FIG. 13(*a*). FIG. 13(*c*) is a sectional view taken along line c—c of FIG. 13(*a*). FIG. 14 is a sectional view taken along XIV—XIV of FIG. 12(*a*). FIG. 15 is a partially enlarged view showing the condition where the cover 70 in FIG. 4 is removed. FIG. 16 is a schematic of cooling water system.

With respect to FIGS. 1–3 (mainly FIG. 1), a personal watercraft 10 is a saddle ride type, personal watercraft, in which a driver is seated on a seat 12 on a watercraft body 11. The watercraft 10 is operated by gripping a steering handle 13 provided with a throttle lever. The watercraft body 11 has a floating structure in which a hull 14 and a deck 15 are joined to each other so as to form a space 16 inside. A water-cooled engine 20 is mounted on the hull 14 at a roughly central portion (roughly central portion with respect to the front-rear direction and the left-right direction of the watercraft 10) in the space 16. A jet pump (jet propulsion pump) 30 driven by the water-cooled engine 20 is provided at a rear portion of the hull 14.

The jet pump 30 includes a flow passage 33 extending from a water intake port 17 opening at a watercraft bottom to a jet port 31 opening at the rear end of the watercraft body. The jet pump 30 also includes a deflector 32, an impeller 34 disposed in the flow passage 33, and a drive shaft 35 of the impeller 34 connected to an output shaft 21 of the engine 20. Therefore, with the impeller 34 driven by the rotation of the engine 20, water drawn in through the water intake port 17 is jetted out through the jet port 31 and the deflector 32, and propulsion of the watercraft body 11 is achieved. The number of drive revolutions of the engine 20, e.g., a propulsion force by the jet pump 30, is controlled by a rotating operation of the throttle lever 13*a* (See FIG. 2) of the operating handle 13. The deflector 32 is linked to the operating handle 13 by an operating wire (not shown) and is turned by an operation on the handle 13, whereby the moving course of the watercraft 10 can be changed. A fuel tank 40 and a containing chamber 41 are also provided.

Now, the water-cooled engine 20 and a containment (fitting) structure for electrical component parts will be described hereinafter. FIG. 4 is a partial, enlarged sectional view taken along line IV—IV of FIG. 1, e.g., mainly of the water-cooled engine 20. FIG. 5 is a right side sectional view of the engine 20. FIG. 6 is a partial, perspective left side view. FIG. 7 is a general perspective view of the engine 20. FIG. 8 is a partial, enlarged view of FIG. 5.

As shown in FIGS. 1 and 5, the water-cooled engine 20 is a DOHC type series, four-cylinder, dry sump, four-cycle engine in which a crankshaft 21 is disposed along a front-rear direction of the watercraft body 11. As shown in FIGS.

4 and 7, a surge tank (intake chamber) 22 in communication with an intake port and an inter-cooler 23 are disposed in connection with the left side of the engine 20 as viewed in the moving direction of the watercraft body 11. As seen in FIG. 6, an exhaust manifold 24 in communication with an exhaust port 20*o* is disposed in connection with the right side of the engine 20.

As shown in FIGS. 6 and 7, a turbocharger 25 is disposed on the rear side of the engine 20, an exhaust outlet 24*o* of the exhaust manifold 24 is connected to a turbine portion 25T of the turbocharger 25, and the inter-cooler 23 is connected to a compressor portion 25C of the turbocharger 25 through a piping 26 (See FIG. 7). In FIG. 7, cooling water hoses 23*a* and 23*b* are connected to the inter-cooler 23.

After rotating a turbine at the turbine portion 25T of the turbocharger 25, the exhaust gas is discharged into a water flow generated by the jet pump 30. As shown in FIGS. 1 and 2, the exhaust gas is discharged into the water flow after passing through an exhaust pipe 27*a*, a reverse flow check chamber 27*b* for preventing back flow of water upon overturning (penetration of water into the turbocharger 25 or the like), a water muffler 27*c*, and an exhaust/draining pipe 27*d*.

As shown in FIGS. 4 to 8, at a front portion of the engine 20 (with respect to the moving direction of the watercraft body 11 and a left portion in FIGS. 1 and 5), an oil tank 50 and an oil pump 80 are integrally provided on an extension line of the crankshaft 21. The oil pump 80 is provided in the oil tank 50. The oil tank 50 is provided with a tank main body 60 joined to a front surface of the engine 20, and a cover 70 joined to a front surface of the tank main body 60.

FIG. 9(*a*) is a plan view of a tank main body according to an embodiment of the present invention. FIG. 9(*b*) is a front view of the tank main body. FIG. 9(*c*) is a sectional view taken along line c—c in FIG. 9(*b*). FIG. 9(*d*) is a sectional view taken along line d—d in FIG. 9(*a*). FIG. 10 is a rear elevational view of the tank main body. FIG. 11(*a*) is a sectional view taken along line e—e of FIG. 8(*b*). FIG. 11(*b*) is a sectional view taken along line f—f of FIG. 9(*b*). FIG. 12(*a*) is a front view of a cover. FIG. 12(*b*) is a sectional view taken along line b—b of FIG. 12(*a*). FIG. 12(*c*) is a sectional view taken along line c—c of FIG. 12(*a*). FIG. 12(*d*) is a sectional view taken along line d—d of FIG. 12(*a*). FIG. 13(*a*) is a rear elevational view of the cover. FIG. 13(*b*) is a view taken along arrow b of FIG. 13(*a*). FIG. 13(*c*) is a sectional view taken along line c—c of FIG. 13(*a*). FIG. 14 is a sectional view taken along XIV—XIV of FIG. 12(*a*). FIG. 15 is a partial, enlarged view showing a condition where the cover 70 in FIG. 4 is removed.

As shown in FIGS. 9, 10 and 15, the tank main body 60 includes a joint surface 61 for the front surface of the engine 20, a joint surface 62 for the cover 70, a fitting surface 63 for the oil pump 80, and a fitting portion 64 for a water-cooling type oil cooler 90. The tank main body 60 also includes a generally vertically elongate, oil containing portion 65 defined by partition walls and outside walls constituting the fitting surfaces and the like, and a cover portion 66 for a driving chamber for a starter motor 120, balancer shafts 114L, 114R and a rotor 110*a* of an ACG (generator) 110. In addition, the tank main body 60 includes a fitting portion 68 for an oil filter 100.

As shown in FIGS. 8, 9, 10 and 15, the cover portion 66 of the tank main body 60 includes an ACG cover portion 66*a* covering the ACG rotor 110*a*, a balancer driving gear 113 and a starter gear 123, a coupling cover portion 66*b* covering a coupling 111 portion, and a right balancer driving system cover portion 66*c* covering the balancer gear 115 and an idle gear 116. The cover portion 66 also includes a left balancer driving system cover portion 66*d* covering a balancer gear 117, and a starter driving system cover portion 66*e* covering a speed reduction gear 122 and a pinion gear 121 of the starter motor 120. A hole 66*f* for supporting a shaft of the speed reduction gear 122 is also provided.

The tank main body 60 as described above is jointed to the front surface of the engine 20 at the joint surface 61 so as to cover the above-mentioned portions with the cover portion 66, and is integrally fixed to the front surface of the engine 20 by bolts (not shown). The tank main body 60 is fitted to the front surface of the engine 20 after being fitted with the oil pump 80 and the oil cooler 90 which will be described hereinafter. As shown in FIGS. 8 and 15, the oil pump 80 includes a first case 81 jointed to the tank main body 60, a second case 82 jointed to the first case 81, a pump shaft 83 piercing through the first and second cases, an oil recovery rotor 84 connected to the pump shaft 83 in the first case 81, and an oil supply rotor 85 connected to the pump shaft 83 in the second case 82.

The oil recovery rotor 84 and the first case 81 form an oil recovery pump. The oil supply rotor 85, together with the first and second cases 81 and 82 form an oil supply pump. The oil pump 80 is fitted to a front surface of the tank main body 60 by a bolt 88 (See FIG. 8) which is inserted into a through-hole 80*a* of the first and second cases 81 and 82, after a joint surface 81*a* of the first case 81 for the tank main body 60 is jointed to a joint surface 69 (See FIGS. 9(*b*) and 9(*c*)) at the front surface of the oil tank main body 60, the joint surface 69 being formed in the same shape as the joint surface 81*a*.

After the oil pump 80 is fitted to the tank main body 60, a coupling 89 is fixed to the rear end of the pump shaft 83 from the rear side of the tank main body 60. As shown in FIGS. 6, 9(*b*) and 15, the water cooling type oil cooler 90 is fitted to the front surface side of the fitting portion 64 of the tank main body 60 for the oil cooler 90. The fitting portion 64 of the tank main body 60 is provided with a lower hole 64*b* and an upper hole 64*a* in communication with an oil passage which will be described hereinafter.

The oil cooler 90, as shown in FIG. 6, includes a plurality of heat exchange plates 91 in which oil passes through the inside thereof. The oil cooler 90 also includes an oil inlet pipe 92 in communication with the inside of the plates 91 at an upper portion thereof, an oil outlet pipe 93 in communication with the inside of the plates 91 at a lower portion thereof, and flange portions 94 and 95 for fitting to the tank main body 60 as shown in FIG. 15. Therefore, the oil cooler 90 is fitted to the fitting portion 64 of the tank main body 60 by fastening the flange portions 94 and 95 by bolts (not shown) so that the inlet pipe 92 is connected to the upper hole 64*a* of the tank main body 60. The outlet pipe 93 is connected to the lower hole 64*b* of the tank main body 60. In FIG. 15, a bolt-passing hole 96 is also provided in each of the flange portions 94 and 95.

The tank main body 60 is provided with a cooling water introducing pipe 97 in communication with a hole 64*c* (See FIGS. 9 and 15) opened at the fitting portion 64 for introducing cooling water to the fitting portion 64 and into an oil cooler containing portion 74 of the cover 70, and the cover 70 is provided with a water discharge pipe 78, as shown in FIGS. 12 to 14. A cooling water hose 97*a* extending from a cooling water take-out portion 30*a* (See FIGS. 7 and 16) of the jet pump 30 is directly connected to the introducing pipe 97, without intermediation by another object of cooling, and a drain pipe 23*c* is connected to the discharge pipe 78 as shown in FIG. 6. Water from the water discharge pipe 78 is supplied into a water jacket of the engine 20 through the drain pipe 23*c*.

As shown in FIGS. 12 to 14, the cover 70 includes a joint surface 71 for the tank main body 60, an oil replenishing port 72, a presser portion 73 of an oil relief valve 130, the containing portion 74 for the oil cooler 90, and an oil containing portion 75 defined by outside walls and partition walls. The cover 70 is jointed to the front surface of the tank main body 60 by fitting the tank main body 60, the oil pump 80 and the oil cooler 90 to the front surface of the engine 20. The rear end 131 of the relief valve 130 is then fitted into a hole 82*a* formed at a front surface of the second case 82 of the oil pump 80 as shown in FIG. 8, and pressing the tip end 132 of the relief valve 130 by the above-mentioned presser portion 73, and is fixed by bolts (not shown). In FIG. 12(*a*), bolt passing holes 76.

When the tank main body 60 and the cover 70 are jointed, their oil-containing portions 65 and 75 form a vertically elongate, single oil-containing portion. In addition, the oil filter 100 is fitted to the fitting portion 68 of the tank main body 60 for the oil filter 100. When the oil tank 50, e.g., the tank main body 60, the cover 70, and the oil pump 80, the oil cooler 90 and the relief valve 130 incorporated therein, is fitted to the front surface of the engine 20 and the oil filter 100 is installed, an oil passage as described hereinafter is formed.

As shown in FIGS. 5 and 8, the front surface of the tank main body 60 and a rear surface of the first case 81 of the oil pump 80 form an oil recovery passage 51. The oil recovery passage 51 is provided with an oil passage 51*a* (See FIG. 9(*b*)) formed on the side of the tank main body 60 and an oil passage 51*b* formed on the side of the first case 81 of the oil pump 80 oppositely thereto. The lower end 51*c* of the oil recovery passage 51 is in communication with an oil pan 28 of the engine 20 through a pipe 52, and the upper end 51*d* of the oil recovery passage 51 is in communication with a recovered oil suction port 81*i* formed in the first case 81 of the oil pump 80.

The front surface of the tank main body 60 and the rear surface of the first case 81 of the oil pump 80 form a recovered oil discharge passage 53. The recovered oil discharge passage 53 is provided with an oil passage 53*a* (See FIG. 9(*b*)) formed on the side of the tank main body 60, and a recovered oil discharge port 81*o* formed on the side of the first case 81 of the oil pump 80 oppositely thereto. The upper end 53*b* of the recovered oil discharge passage 53 opens into the oil tank 50, e.g., into the oil-containing portion (See FIGS. 9(*b*) and 15).

As shown in FIG. 8, the front surface of the first case 81 and a rear surface of the second case 82 in the oil pump 80 form a suction passage 54 and a discharge passage 55 for the supplied oil. The lower end 54*a* of the suction passage 54 opens into the oil tank 50, e.g, into the oil-containing portion, while the upper end 54*b* of the suction passage 54 is in communication with a supplied oil suction port 82*i* of the oil supply pump. A screen oil filter 54*c* is provided in the suction passage 54.

The lower end 55*a* of the discharge passage 55 is in communication with a supplied oil discharge port 82*o* of the oil supply pump, while the upper end 55*b* of the discharge passage 55 laterally pierces through an upper portion of the first case 81 and is in communication with a horizontal hole 60*a* formed in the tank main body 60 (See FIGS. 9(*b*) and 15). The horizontal hole 60*a* is in communication with a vertical hole 60*b* formed similarly in the tank main body 60, as shown in FIGS. 8, 9(*b*) and 15. The upper end 60*c* of the vertical hole 60 opens in a ring shape in plan view into the fitting portion 68 for the oil filter 100 (See FIG. 9(*a*)), and an oil inflow passage 101 (See FIG. 15) of the oil filter 100 is in communication with the opening 60*c*. The fitting hole 82*a* for the relief valve 130 described above opens into the discharge passage 55, and the relief valve 130 is fitted into the fitting hole 82*a* in the manner described above.

As shown in FIG. 15, an oil outlet pipe 102 of the oil filter 100 is provided with a male screw, and the oil outlet pipe 102 is screw-engaged into a female screw hole 60*d* (See FIGS. 9(*a*) and 9(*b*)) formed in the fitting portion 68 of the tank main body 60, whereby the oil filter 100 is fitted to the fitting portion 68 of the tank main body 60. The fitting portion 68 is integrally formed with a peripheral wall 68*a*, and the peripheral wall 68*a* and a side wall surface 68*b* of the tank main body 60 continuous therewith form an oil-receiving portion 68*c*. Therefore, oil dripping at the time of fitting or detaching the oil filter 100 to or from the fitting portion 68 is received by the oil-receiving portion 68*c* and returns through the female screw hole 60*d* or the opening 60*c* into the oil tank. Accordingly, the inside of the watercraft body is not easily stained with the oil.

As shown in FIGS. 9(*a*), 9(*b*) and 15, a lower portion of the female screw hole 60*d* is provided with a vertical hole 60*e* and a horizontal hole 60*f* in communication with the lower end of the vertical hole 60*e*. The horizontal hole 60*f* is in communication with the inlet pipe 92 of the oil cooler 90 through the upper hole 64 in the fitting portion 64 for the oil cooler 90 described above (See FIG. 6).

The lower hole 64*b* of the tank main body 60, to which the outlet pipe 93 of the oil cooler 90 is connected, is provided with an oil passage 60*g* in communication with the lower hole 64*b* and an oil distribution passage 60*h* in communication with the passage 60*g* (as shown in FIG. 11(*b*)). Further, a main gallery supply passage 60*i* for supplying oil to a main gallery 20*a* (See FIG. 5) of the engine 20, a left balancer supply passage 60*j* for supplying oil to a bearing portion of the left balancer 114L described above, and a right balancer supply passage 60*k* for supplying oil to the right balancer 114R, are in communication with the oil distribution passage 60*h*.

The supply passages 60*j* and 60*k* for the balancers 114(L, R) are each in communication with the oil distribution passage 60*h* through a narrow passage 60*m*. One end 60*h*1 of the oil distribution passage 60*h* is closed with a plug 60*n* (See FIG. 6). The oil supplied from the oil cooler 90 to the main gallery 20*a* of the engine 20 is supplied to each portion of the engine. The oil then returns into the oil pan 28, and is recovered into the oil tank 50 after passing through the pipe 52, the recovery passage 51, the oil pump 80 (recovery pump) and the recovered oil discharge passage 53, to be circulated from the suction passage 54 along the above-mentioned path.

As shown in FIG. 16, cooling water flows along the path described hereinafter. Cooling water flowing from the cooling water take-out potion 30*a* of the jet pump 30 passes through a main hose 35, and is branched into the cooling water hoses 97*a* and 23*a* by a three-way valve 37 provided with a one way function. The cooling water passing through the cooling water hose 97*a* is supplied through the above-mentioned cooling water introducing pipe 97 into the oil cooler containing portion (water tank) 74, while the cooling water passing through the cooling water hose 23*a* is supplied to the inter-cooler 23 as described above.

Water in the exterior of the watercraft is directly introduced into the oil cooler containing portion (water tank) 74 and the inter-cooler 23, without being intermediated by another object of cooling. The water having been supplied into the oil cooler containing portion (water tank) 74 and having cooled the oil cooler 90 is supplied through the discharge pipe 78 and the piping 23*c* to the water jacket of the engine 20 to cool the engine 20 as described above. The water is then discharged to the exterior of the watercraft through a first drain pipe 38*a*.

On the other hand, the water having been supplied to the inter-cooler 23 and having cooled a heat exchanger is supplied through the piping 23*b* to a water jacket of the exhaust manifold 24, to cool the exhaust manifold 24, and is thereafter discharged to the exterior of the watercraft through a piping 24*a* and a second drain pipe 38*b*. In addition, a portion of the cooling water supplied to the exhaust manifold 24 is supplied to a water jacket of the turbocharger 25 through a piping 24*b*. The water having cooled the turbocharger 25 is supplied to the exhaust pipe 27*a* connected to the turbocharger 25 and having a water jacket in communication with the water jacket of the turbocharger 25. A portion of the water is discharged into the exhaust gas at a downstream portion of the exhaust pipe 27*a*, and is discharged together with the exhaust gas into the water flow generated by the jet pump 30 through the reverse flow check chamber 27*b*, the water muffler 27*c* and the exhaust/drain pipe 27*d* as described above.

A portion of the water having been supplied to the exhaust pipe 27*a* and having cooled the exhaust pipe 27*a* is further supplied to the reverse flow check chamber 27*b* connected to the exhaust pipe 27*a* and to the exhaust pipe's water jacket in communication with the water jacket of the exhaust pipe 27*a*. The water cools the reverse flow check chamber 27*b*, and is thereafter discharged to the exterior of the watercraft through a piping 39 and the second drain pipe 38*b*.

A containment (fitting) structure containing an electrical component part of the water-cooled engine as described above will be described hereinafter. In the present embodiment, as shown in FIGS. 4 and 6, the electrical component parts 43 likely to generate heat are fitted to an outside wall surface 74*a* of the water tank (oil cooler containing portion) 74, including the oil cooler 90 in the inside thereof, and are enclosed within the containment structure shown. The containment structure includes the housing enclosing electrical component parts 43 and cooperates with the outside wall surface 74*a* to enclose the electrical components as seen in FIG. 6. As seen in FIGS. 12 and 14, a fitting portion 74*a*1, and the electrical component parts 43 are fitted by screw-engaging bolts 44, 44 (See FIG. 4) into threaded holes 74*b*, 74*b* of the fitting portion 74*a*1.

While the electrical component part 43 shown in the accompanying drawings is a rectifier connected to the generator 110, the electrical component part 43 fitted to the outside wall surface 74*a* of the water tank 74 is not limited to the rectifier, and may be an electrical component part(s) which is(are) likely to generate heat. The fitting position of the electrical component part 43 may be any position on the outside wall surface of the cooling water passage in the water-cooled engine 20. For example, other than the water tank 74, the electrical component part 43 may be fitted to an outside wall surface of the inter-cooler 23 into which cooling water is introduced directly.

According to the containment structure for the electrical component parts as described above, the following effects can be obtained. Since the electrical component parts 43 are fitted to the outside wall surface of the cooling water passage in the water-cooled engine 20 mounted on the watercraft, the electrical component part 43 is cooled by cooling water passing through the cooling water passage of the water-cooled engine 20 through the outside wall surface. Therefore, a rise in the temperature of the electrical component part 43 is prevented.

Specifically, if the electrical component part 43 is a rectifier connected to the generator 110 of the engine, the rectifier is liable to acquire a high temperature due to heat generation. However, the present fitting structure ensures that the rectifier 43 can be favorably cooled. The present containment structure is particularly effective where the electrical component part 43 is a component part that is liable to generate heat.

In addition, engine 20 has a large weight and is disposed at a central portion of the interior 16 of the watercraft. However, a small amount of water that may be present in the watercraft would not easily splash onto the engine 20, even when the watercraft is heavily pitched, rolled or even capsized. Since the electrical component part is installed to the outside wall surface of the engine 20, so that water would not easily splash onto the engine 20 and therefore would not be splashed onto the electrical component part 43. Therefore, a waterproofing treatment for the electrical component parts 43 can be simplified.

Since the water-cooled engine 20 integrally includes the water tank 74 that forms the cooling water passage and the oil cooler 90 in the inside thereof, and the electrical component part 43 is fitted to the outside wall surface 74*a* of the water tank 74, the following effect(s) can further be obtained. Namely, since a comparatively large quantity of cooling water passes through the water tank 74, including the oil cooler 90 in the inside thereof, the electrical component part 43 is easily cooled and a rise in the temperature is prevented.

Since water in the exterior of the watercraft is directly introduced into the cooling water passage 74 of the water-cooled engine, without intermediate introduction into another object to be cooled, cooling water at a comparatively low temperature is introduced into the cooling water passage 74. In contrast, cooling water is at a higher temperature when cooling water is introduced after cooling another object of cooling. Therefore, the electrical component part 43 is favorably cooled and a rise in temperature is prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water-cooled engine mounted on a watercraft, comprising:

a water-cooled oil cooler having a cooling water passage, said cooling water passage having an exterior wall surface with a fitting portion, wherein said exterior wall surface encloses a cooling water containing portion of said water-cooled oil cooler; and a containment structure for an electrical component of the water-cooled engine having a plurality of interior wall surfaces, wherein said electrical component is housed within said containment structure and is secured to the fitting portion of the exterior wall surface of the cooling water passage and is surrounded by the interior wall surfaces of the containment structure.

2. The water-cooled engine according to claim 1, wherein said electrical component part is a rectifier connected to a generator of said water-cooled engine by a pair of bolts to said fitting portion.

3. The water-cooled engine according to claim 1, further comprising:

an oil tank main body having an exterior surface; and a cover being engaged with the exterior surface of the oil tank main body, said cover enclosing the containment structure.

4. The water-cooled engine according to claim 2, further comprising:

an oil tank main body having an exterior surface; and a cover being engaged with the exterior surface of the oil tank main body, said cover enclosing the containment structure.

5. A water-cooled engine for mounting on a watercraft, said engine comprising:

at least one electrical component for the water-cooled engine;

a containment structure containing the at least one electrical component; and a cooling water passage for the engine, said cooling water passage having an exterior wall surface, wherein said cooling water passage supplies cooling water for at least one of an intercooler and a water-cooled oil cooler and the electrical component is secured to a fitting portion of the exterior wall surface and is surrounded by interior wall surfaces of said containment structure.

6. The engine according to claim 5, wherein said cooling water passage is a cooling water containing portion of the water-cooled oil cooler and said electrical component is secured to said fitting portion by a pair of bolts.

7. The engine according to claim 5, further comprising a water supply from the exterior of said watercraft being introduced directly into said cooling water passage in said water-cooled engine.

8. The engine according to claim 6, further comprising a water supply from the exterior of said watercraft being introduced directly into said cooling water passage in said water-cooled engine.

9. The engine according to claim 5, wherein said electrical component part is a rectifier connected to a generator of said water-cooled engine.

10. The engine according to claim 5, wherein said electrical component part is a rectifier connected to a generator of said water-cooled engine.

11. The engine according to claim 8, wherein said electrical component part is a rectifier connected to a generator of said water-cooled engine.

12. The engine according to claim 5, further comprising:

an oil tank main body having an exterior surface; and a cover engaged with the exterior surface of the oil tank main body.

13. The engine according to claim 11, further comprising;

an oil tank main body having an exterior surface; and a cover engaged with the exterior surface of the oil tank main body.

14. A method of cooling an electrical component for a water-cooled engine of a watercraft according to claim 5, the method comprising the steps of:

securing at least one electrical component for the water-cooled engine to the exterior wall surface of the cooling water passage of the engine; and cooling said at least one electrical component with a supply of cooling water supplied directly from an exterior of the watereraft to said cooling water passage.

15. The method of cooling according to claim 14, wherein the exterior wall surface of said cooling water passage is a surface of a water containing portion for the oil cooler.

16. The method according to claim 14, wherein the at least one electrical component includes a rectifier connected to a generator of said water-cooled engine.

* * * * *